United States Patent [19]

Nelson et al.

[11] Patent Number: 4,553,924

[45] Date of Patent: Nov. 19, 1985

[54] JACKSHAFT CONTROLLED BOILER COMBUSTION CONTROL SYSTEM

[75] Inventors: Robert L. Nelson, Orrville; Donald M. Stough, Jackson Township, Jackson County, both of Ohio

[73] Assignee: Westinghouse Electric Corp., Pittsburgh, Pa.

[21] Appl. No.: 617,060

[22] Filed: Jun. 4, 1984

Related U.S. Application Data

[62] Division of Ser. No. 407,677, Aug. 12, 1982, Pat. No. 4,486,166.

[51] Int. Cl.[4] ..... F23N 1/00

[52] U.S. Cl. ..... 431/12; 431/76; 236/15 BD; 236/15 E

[58] Field of Search ..... 431/12, 76, 90, 20, 431/89; 236/15 BD, 15 E

[56] References Cited

U.S. PATENT DOCUMENTS

| | | | |
|---|---|---|---|
| 3,549,089 | 12/1970 | Hamlett | 431/12 X |
| 4,249,886 | 2/1981 | Bush | 431/12 X |
| 4,348,169 | 9/1982 | Swithenbank et al. | 431/12 X |
| 4,396,369 | 8/1983 | Kaessmann | 431/76 |
| 4,436,506 | 3/1984 | Berkhof | 431/76 |
| 4,439,138 | 3/1984 | Craig et al. | 431/12 |

*Primary Examiner*—Randall L. Green
*Attorney, Agent, or Firm*—Thomas R. Trempus

[57] ABSTRACT

An improved combustion control system for a jackshaft controlled boiler or the like utilizes a second power actuator, a linkage biasing mechanism and a function generator which provides a position control signal as a function of the boiler load in order to position the linkage biasing mechanism to obtain an automatically calibrated, near optimum relationship between fuel and air. An alternative embodiment of this invention includes a flue gas analysis system where the position control signal is modified to further enhance combustion efficiency. This invention also includes a method for programming a programmable combustion control system according to this invention.

1 Claim, 5 Drawing Figures

JACKSHAFT CONTROLLED BOILER COMBUSTION CONTROL SYSTEM

This is a division of application Ser. No. 407,677, filed Aug. 12, 1982 now U.S. Pat. No. 4,486,166.

BACKGROUND OF THE INVENTION

1. Field of the Invention

The invention relates to a combustion control system typically used with a combustion apparatus such as a boiler, a heater or the like.

2. Description of the Prior Art

It is known to mechanically connect the valves of a boiler controlling fuel feed and air intake in order to establish a definite and selectable air to fuel or oxygen to fuel ratio. The simplest and least expensive combustion control system is known as the "jackshaft" positioning system. This system consists of a mechanical linkage arrangement in which a master arm is connected to a main shaft for controlling the fuel valves and a slave arm is connected to the air damper and is responsive to the main shaft through an intermediate linkage strut. Such a mechanical arrangement establishes a master-slave relationship between the fuel valves and air damper. The intermediate linkage strut of the prior art system is adjusted, to provide a fuel to air ratio which remains generally satisfactory through all load requirements of the combustion apparatus.

However, in order to maximize combustion process efficiency through various load requirements, changes in the BTU value of the fuel, viscosity of the fuel, combustion air temperature, burner clogging, etc., the original calibrated relationship between fuel and air must be adjusted. Such an adjustment is often referred to as an oxygen trim adjustment and may be necessary several times a day. While such adjustments can be effected by changing the interconnecting points at the opposite ends of the linkage strut, such mechanical manipulation is obviously time consuming and necessitates a recalibration of the jackshaft positioning system.

It is also known to utilize a jackshaft positioning system which includes a cam mechanism inserted between the jackshaft and the air or fuel valves. In such an arrangement, a limited degree of predetermined variance can be established in the air to fuel relationship through the geometry of the cam mechanism. While some degree of modification to the air-fuel ratio is available, the aforedescribed problems relating to changes in the BTU value of the fuel, viscosity of the fuel, combustion air temperature, etc., still demand that original calibrated relationship between fuel and air be adjusted. The frequent mechanical modifications to the cam mechanism necessary to provide the adjustments to the original calibrated relationship is not a useful solution for these problems.

It is taught in U.S. Pat. No. 4,249,886, which patent is assigned to the assignee of the present application, that an angularly modifiable trim link can be incorporated into a jackshaft positioning system. The trim link allows the conventional master-slave relationship between the fuel control and damper control means to continue. In addition to the conventional fixed master-slave relationship, the trim link effects slight adjustments to the damper means in order to better regulate the air-fuel ratio. The specific articulation of the trim link is controlled by a trim positioner means which is responsive to a control system.

U.S. Pat. application Ser. No. 392,978, now U.S. Pat. No. 4,479,774, assigned to the assignee of the present invention discloses a combustion control system which includes a linkage strut adjustor apparatus that modifies the air-fuel ratio. This adjustor apparatus is remotely actuated and includes an overload protection cylinder which minimizes the possibility of mechanical damage to either the adjustor apparatus itself or the jackshaft system.

It is an object of this invention to provide an improved jackshaft controlled boiler control system which maintains an optimum air-fuel ratio relationship at all boiler loads.

It is also an object of this invention to utilize a programmable control system responsive to external computation, such as boiler load index, and flue gas analysis to establish an optimum air-fuel relationship at all boiler loads.

It is still a further object of this invention to disclose a method of programming a programmable control system in order to establish and maintain automatically thereafter the efficient and effective control of a jackshaft controlled boiler control system.

SUMMARY OF THE INVENTION

An improved combustion control system for a combustion apparatus such as a boiler or the like controlled by a jackshaft system utilizes the load index signal output of the jackshaft system to effect trim control of the air fuel ratio of the combustion process. A linkage biasing mechanism is operably associated with the intermediate linkage strut of the jackshaft system to modify the longitudinal dimension of the strut. A means for generating a position control signal is responsive to the load index signal and an actuator is responsive to the position control signal. The actuator is in communication with the biasing mechanism in order to effect the manipulation thereof. A flue gas analysis system is incorporated into this improved combustion control system in an alternative embodiment to provide additional refinement to the trim control linkage biasing mechanism.

The invention also includes a method for programming a programmable air-fuel combustion control system in which the function between the boiler load signal and the position of the biasing mechanism and/or the set point of the flue gas analyzer controller is determined by manually establishing a jackshaft position and biasing mechanism position and/or the flue gas analyzer output at two or more load points. A microcomputer stores this positional and/or flue gas output relationship so that in automatic operation, the combustion control system of this invention duplicates these relationships.

BRIEF DESCRIPTION OF THE DRAWINGS

The above as well as other features and advantages of this invention will become apparent through consideration of the detailed description in connection with the accompanying drawings in which.

DETAILED DESCRIPTION OF THE INVENTION

Figure 1:
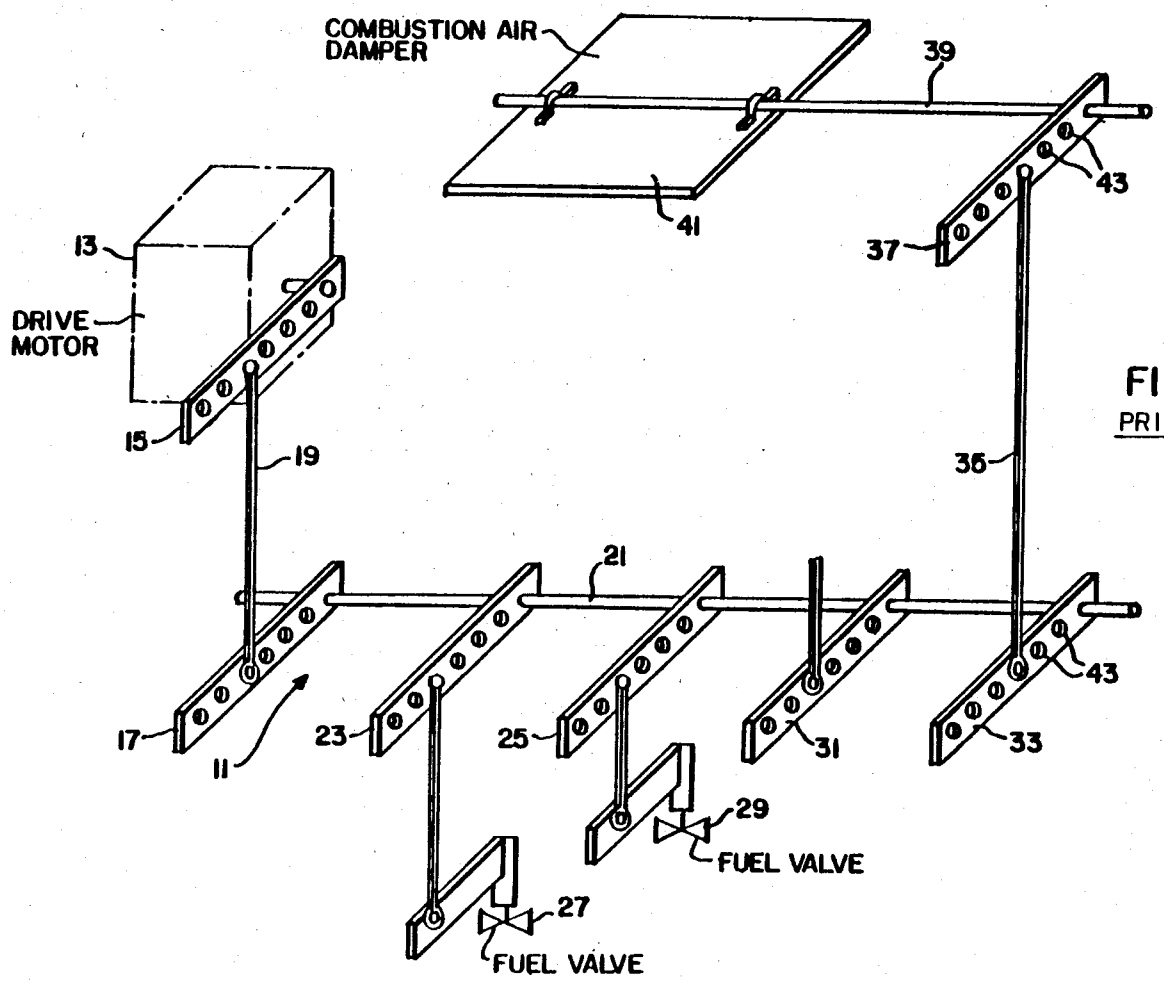
FIG. 1. PRIOR ART
FIG. 1 is a somewhat schematical illustration of a conventional jackshaft system typically used to control the air-fuel ratio of a boiler.

Referring to FIG. 1, a combustion control system of the prior art known as the "jackshaft" or "single-point" positioning system is shown. This arrangement is often used because of its low cost and reliability, especially in gas and oil fired boiler application. While the prior art jackshaft system illustrated in FIG. 1 is of the type in which a master arm and slave arm are interconnected by means of an intermediate linkage strut of fixed longitudinal dimension, it is to be understood that this jackshaft system is presented only as an exemplar. As should be readily appreciated by those skilled in the art of boiler control systems, the present invention is not limited to such a jackshaft system, or the jackshaft system which includes cam mechanisms. It should additionally be recognized that although air-fuel relationship modifications are generally discussed throughout as being effected through air trim adjustments, the fuel supply can also be adjusted in order to optimize combustion efficiency. In other words, the teachings of this invention can be incorporated into an existing combustion control system to control either the air supply or the fuel supply of a combustion apparatus. The control system, generally indicated by the reference character 11, includes a drive motor 13 having two arms 15 and 17 interconnected by a linking member 19 for activating a main shaft 21. The main shaft 21 actuates arms 23 and 25 which manipulate fuel valves 27 and 29 respectively and arm 31 which may actuate an optional register (not shown). The fuel valves 27 and 29 normally provide a gas or oil fuel source to the boiler, so only one of the fuel valves would be manipulated at a time. The main shaft 21 also actuates a master member 33 which is interconnected by means of an intermediate linkage strut 35 with a slave member 37 mounted on a second shaft 39. The second shaft 39 is thus a slave of the master shaft 21. When the slave shaft 39 is rotated, a combustion air damper 41 is orientated in different planes to increase or decrease the air intake. All of the arms extending from both shafts 21 and 39 are provided with several holes 43 in order to permit basic ratio adjustment between shafts and connected members (such as fuel valves 27 and 29) to vary the effects of each arm in the system.

Once calibrated to a fixed master-slave relationship, the prior art system of FIG. 1 provides no means of varying the percentage of rotation between the master shaft 21 and the slave shaft 39 without physically loosening the arms 33 and/or 37 and reclamping the same at a new position on its shaft, or changing the length of the intermediate linkage strut 35 by remounting it in a different hole.

On this type of control system, the arms on the master shaft 21 position the fuel valves (oil, gas, etc.). Thus a given position of the shaft 21 represents a specific volume of fuel flow to the burner. Likewise, the position of the slave shaft 39 represents a specific volume of combustion air flow to the burner. If, after an initial relationship between fuel valves and combustion air damper has been established, there occurs a change in the BTU value of the fuel, viscosity of the fuel, combustion air density, valve wear, burner clogging, etc., the original calibrated relationship has an obvious impact on combustion efficiency, total fuel cost and polution from the combustion process.

Although the cost of operations can be reduced by maintaining the proper air to fuel ratio, few plants have installed systems that provide a means of controlling the air to fuel ratio. This is at least in part due to the down time required for the installation of such a system and relative complexity of these systems. Often a completely new type of combustion control system has to be designed, or extensive modifications to the existing control system have to be made. In any event, combustion apparatus down time, recalibration of the new system, and expensive installation time are required.

Figure 2:
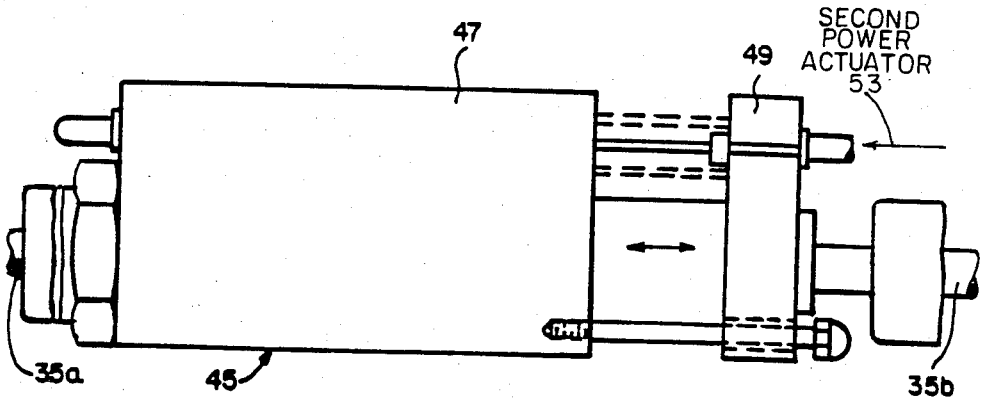
FIG. 2 is a side elevation view of a linkage strut adjustor apparatus.
Figure 3:
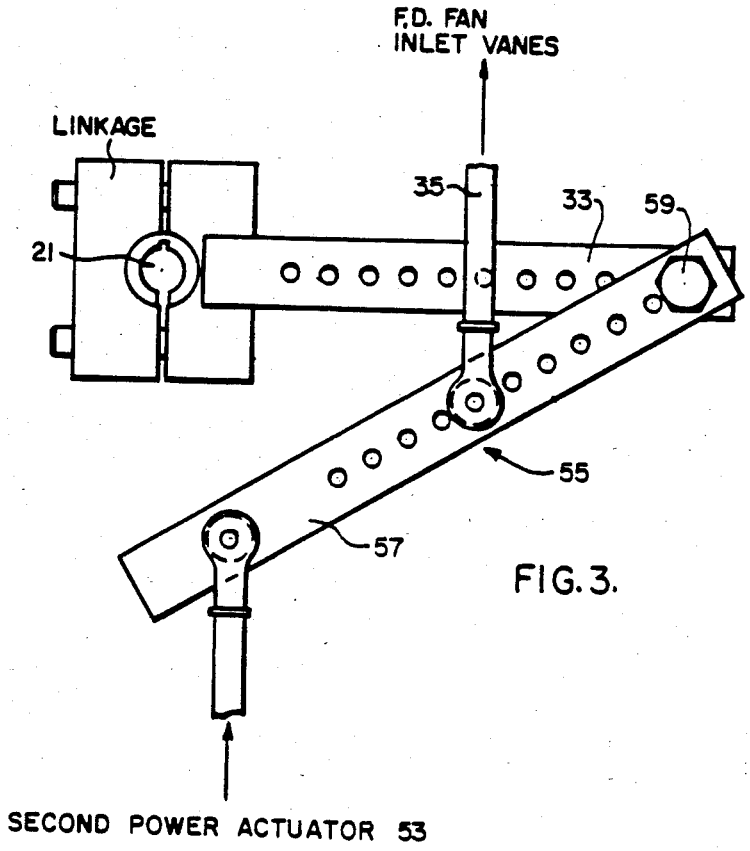
FIG. 3 is a side elevation view of a trim link apparatus.

This invention provides a system for optimizing the air to fuel ratio established by a combustion control system and includes mechanically incorporating an intermediate linkage strut biasing mechanism such as shown in either FIG. 2 or FIG. 3 into the jackshaft control system 11. Two such biasing mechanisms either of which can be interconnected with the intermediate linkage strut 35 of the jackshaft control system, are the intermediate linkage strut adjustor apparatus disclosed in U.S. patent application Ser. No. 392,978 and the trim link disclosed in U.S. Pat. No. 4,249,886. The above-identified application and patent are assigned to the assignee of the subject application and the subject matter contained therein is incorporated herein by reference. Both the linkage strut adjustor apparatus and the trim link are responsive to an external computation, typically the output signal of a gas analysis system and based upon this output, mechanically modify the master-slave relationship in the jackshaft system.

The linkage strut adjustor apparatus 45, as shown in FIG. 2 and disclosed in the afore-described U.S. patent application Ser. No. 392,978, replaces a section of the intermediate linkage strut 35 in order to selectively modify the heretofore fixed longitudinal dimension of the strut 35. The strut adjustor 45 includes a first member 47 secured to one section of the intermediate linkage strut **35*a* and a second member 49 secured to another section of the intermediate linkage strut 35*b*. Thus, while the direct mechanical master-slave relationship is maintained, trim modification can be effected through the operation of the strut adjustor apparatus 45. The first member 47 and the second member 49 are movably interconnected to each other. A second power actuator means 53, (see FIGS. 4 and 5) either incorporated into the strut adjustor itself, or remotely mounted is in communication with the strut adjustor 45** to effect the aforesaid movement.

The trim link 55 which is illustrated in FIG. 3 and disclosed in the afore-described U.S. Pat. No. 4,249,886 includes a member 57 pivotally connected at one end 59 to the master member 33 and at the other end to a second power actuator means 53 which causes the member 57 to pivot as at 59. The intermediate linkage strut 35 is pivotally connected to the member 57 whereby the master-slave relationship is now a function of both the position of the master member 33 and the position of the trim link 55.

Figure 4:
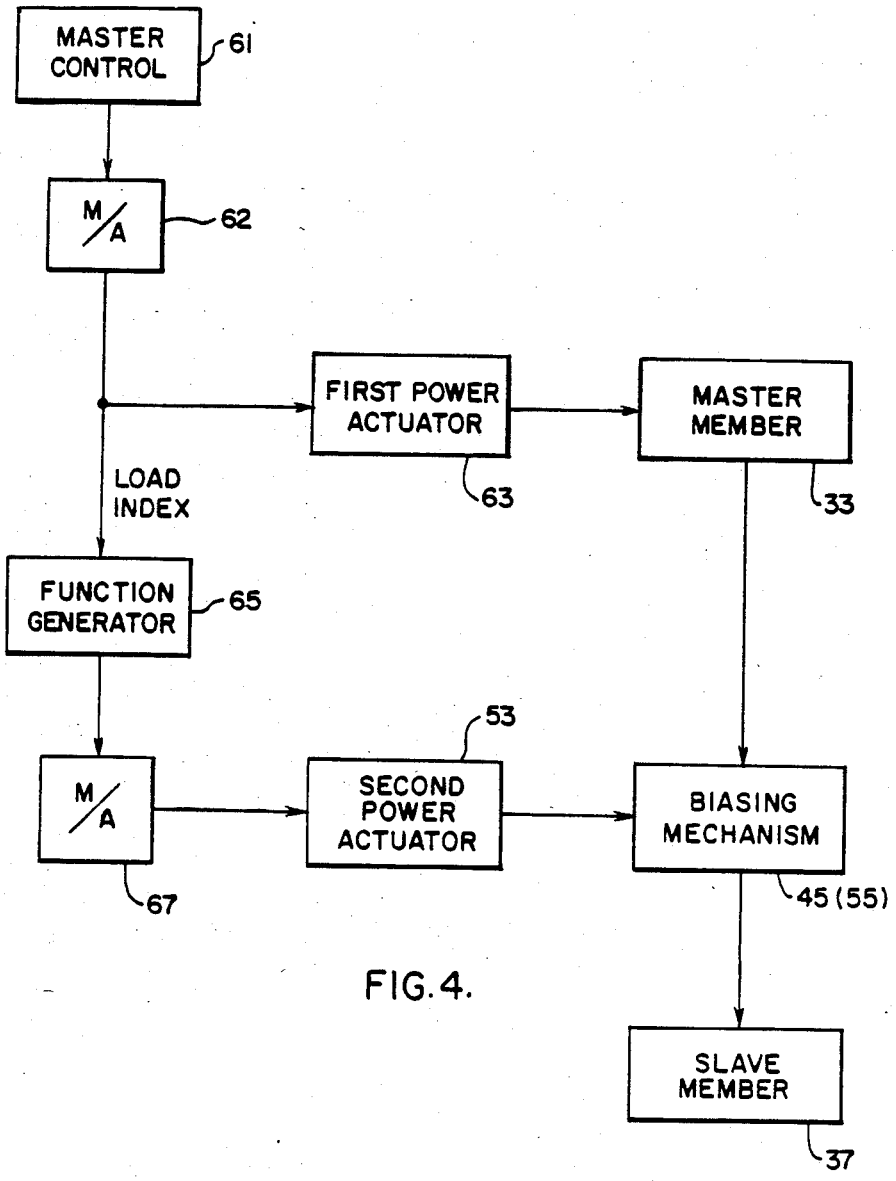
FIG. 4 is a block diagram of a first embodiment of the improved combustion control system of this invention.

Turning now to FIG. 4, a first embodiment of this invention is shown in block diagrammatic form. A combustion apparatus, such as a boiler has a master control unit 61 which is generally responsive to steam pressure or process fluid temperature or the like. The master control unit 61 generates as an output, a load index signal which activates a first power actuator 63 (such as the drive motor 13 in FIG. 1). A boiler master manual control station 62 is provided as shown. The power actuator 63 drives the master member and initiates the master-slave relationship of the jackshaft system. A programmable function generator 65 which has been programmed according to a method which will be hereinafter fully described, has stored in its memory at least two boiler demand load requirements. That is, the second power actuator 53 position for a given load index signal. The load index signal also represents a position of the master member of the jackshaft system. The function generator 65 generates from the load index signal a position control output signal which actuates the second power actuator means 53 which in turn, adjusts the biasing mechanism 45 (or 55). Thus, the simple mechanical relationship between air and fuel as established by the jackshaft system is maintained to provide a somewhat coarse adjustment to the combustion process while the function generator in the combustion control system of this invention finely adjusts the combustion process. A manual-automatic switching station 67 is included to allow the disabling of the biasing device control system for operation of the boiler by the jackshaft system alone. It should also be appreciated that in either embodiment of this invention, the coarse, master-slave adjustment process of the jackshaft system will continue to function should any of the components of the biasing mechanism control system of this invention fail.

Figure 5:
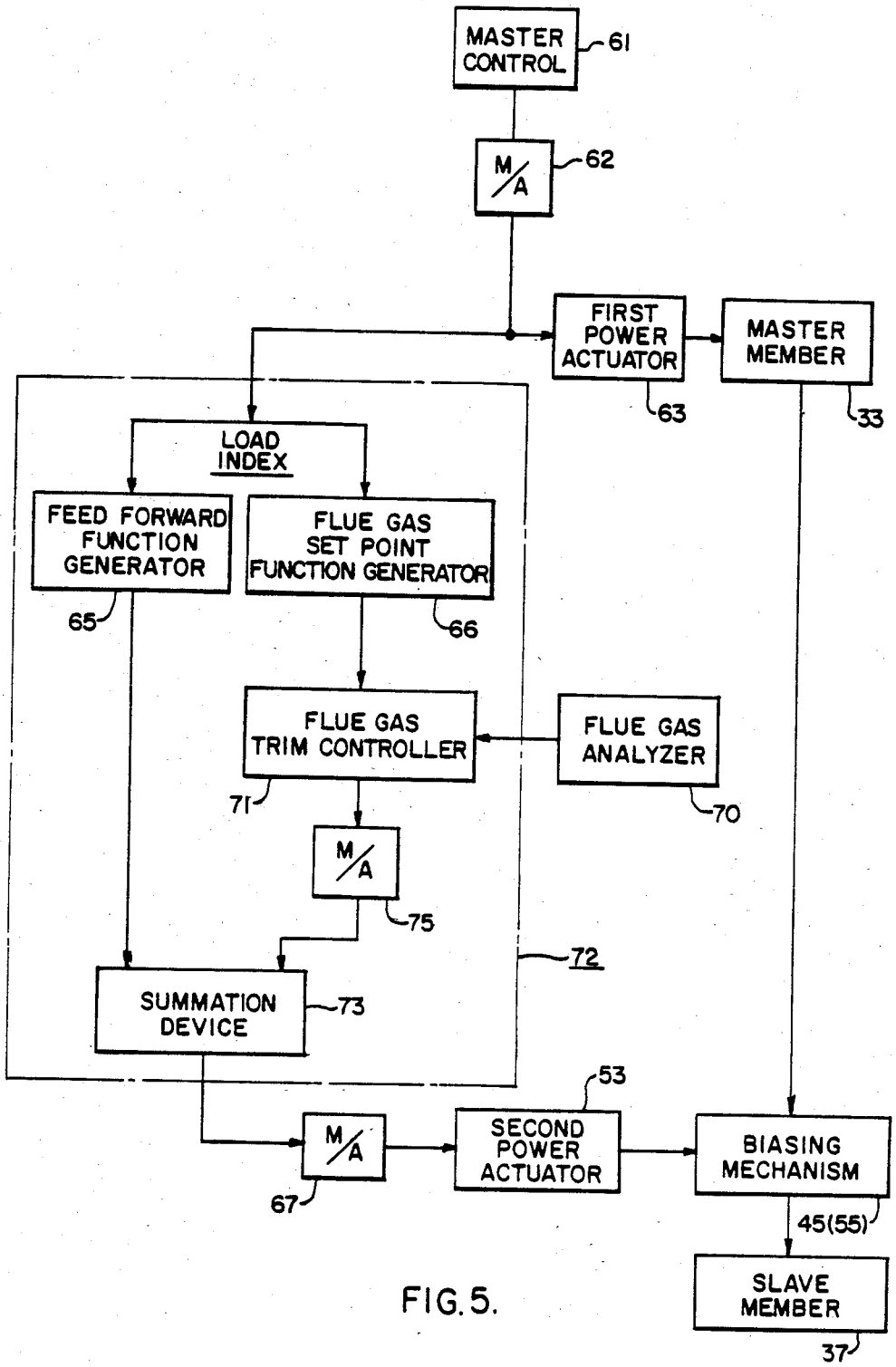
FIG. 5 is a block diagram of an alternative embodiment of the improved combustion control system of this invention including a flue gas analysis system.

An alternative embodiment of this invention is shown in block diagrammatic form in FIG. 5. The master control 61 provides a load index signal through the boiler master manual control station 62 to the first power actuator 63, the feedforward function generator 65 and the flue gas set point function generator 66. The first power actuator 63 rotates the master member 33 in order to adjust the fuel flow and establish the coarse fuel-air ratio through the simultaneous rotation of the slave member 37. The feedforward function generator 65 utilizes the load index signal to generate a position control output signal. The flue gas set point function generator 66 provides a flue gas analyzer set point reference to the flue gas trim controller 71. During the operation of this combustion control system, both the output of the feedforward function generator 65 and the flue gas set point reference output of the flue gas set point function generator 66 are functions of the load index output of the master control 61. A flue gas analyzer 70 which identifies the amount of a particular gas constituent in the combustion products provides an output signal reflective of combustion efficiency. The flue gas analysis system can measure for example, the oxygen, carbon monoxide or carbon dioxide content in the flue gas. The flue gas analysis output signal is provided to the flue gas trim controller 71. The flue gas trim controller 71 generates a second position control signal, based on the flue gas set point and flue gas analyzer output, which is combined in a summation device 73 with the first position control signal of the feedforward function generator 65. The summation device 73 actuates the second power actuator means 53 which adjusts the biasing mechanism 45 (or 55). Thus, the adjustment of the biasing mechanism to effect trim control of the combustion process is now a function of both the pre-established optimum trim position generated by the feedforward function generator 65 and the flue gas trim controller 71. If a microcomputer 72 is utilized, it would provide an output position control signal based upon both the load index signal and the output signal of the gas analysis system. Here again, in this embodiment the coarse adjustment of the air-fuel ratio of the mechanical jackshaft system is maintained while the control system of this invention provides a fine trim control to the combustion process. Also a manual-automatic control 75 is provided to disengage the flue gas analyzer 71. In which case, the load index feedforward system can remain on line or also be disengaged by control station 67. Should a casualty occur or maintenance be required in the trim control system of this invention, the coarse adjustment of the air-fuel ratio of the jackshaft system remains operational.

This invention also provides a method of programming the programmable air-fuel control system of a combustion apparatus as described above. It is the object of the control system programming operation to establish: (1) a relationship between the load index signal and biasing mechanism position; and (2) a relationship between the load index signal and the flue gas set point when flue gas analysis is used. These relationships are established by simply operating the boiler manually and allowing the microcomputer to "learn" the best calibration for optimum combustion efficiency.

With the microcomputer in the learn mode, each of two or more load points of the boiler's load are manually established with optimum firing conditions. As an example, low, medium and high load conditions can be selected. The microcomputer reads the load index signal and the position of the biasing mechanism 45 (or 55) and the flue gas value which provides the optimum air-fuel ratio at that load index signal and stores this data in order to produce the required setpoint information for automatic combustion control. If the boiler has the capacity for both gas and oil operations, the steps of this programming method are repeated for each fuel use.

A typical learning cycle includes the following steps: (1) With the entire system in a manual mode of operation the desired air fuel mixture for a given load demand is established. (2) The microcomputer reads both the position of the biasing mechanism 45 (or 55), the flue gas analyzer value and the load index signal which controls the first power actuator 63. (3) This information is stored by the microcomputer 72 for recall during automatic combustion control operation. These steps are repeated for each desired boiler load condition.

With the stored information the automatic combustion control system of this invention responds to changes in the boiler load by adjusting the biasing mechanism 45 (or 55) and the flue gas set point output to the flue gas trim controller 71 in accordance with the stored position information.

What has been described is a system for optimizing the air to fuel ratio initially established by a jackshaft system by automatically effecting trim control through a pre-programmed biasing mechanism position system used either alone or in combination with a flue gas analysis system.

We claim:

1. A method of programming a programmable combustion control system which controls the air fuel intake ratio of a combustion apparatus supplied with first and second reagents, one of said reagents consisting of fuel and the other of said reagents consisting of a combustive agent including oxygen, said combustion apparatus having a master firing rate demand means responsive to a sensed demand which provides a load index signal output proportional to the sensed demand requirements; a jackshaft means including a master member movably mounted about a first axis, a first actuator responsive to said load index signal output for effecting master member movement, a slave member movably mounted about a second axis having means associated therewith for regulating the amount of one of said reagents supplied, an intermediate linkage strut connected between said master member and said slave member; an intermediate linkage biasing mechanism operably associated with said intermediate linkage strut for effecting the modification of a master slave relationship established by said intermediate linkage strut for regulating the amounts of reagents supplied; means for generating a position control signal, said position control signal generating means producing a predetermined control signal which is a function of the load index signal output; and second actuator means responsive to said positioning control signal and operatively associated with said linkage biasing mechanism for effecting the operation thereof, whereby said master slave relationship is modified prior to the combustion process so that the amount of reagent supplied to said combustion apparatus by said slave member is a function of said master slave relationship as modified by said linkage biasing mechanism; said programmable combustion control system providing a signal to which said linkage biasing mechanism is responsive; said method of programming comprising the steps of:

manually establishing predetermined positions of said jackshaft means and said adjustable linkage biasing means at each of two or more manually established demand requirements as identified by separate load index signals, wherein said predetermined positions optimize the air-fuel ratio at said manually established demand requirement positions; and storing said predetermined positions of said jackshaft means and said adjustable linkage biasing means for said respective manually established demand requirements in said programmable combustion control system, said system responding to changes in boiler load during boiler operation by adjusting the position of said linkage biasing means in accordance with said stored positional information whereby said programmable combustion control system stores control signals representative of positions of the intermediate linkage biasing mechanism for affecting trim control prior to the combustion process.

* * * * *